US011598060B1

(12) United States Patent
Broussard

(10) Patent No.: US 11,598,060 B1
(45) Date of Patent: Mar. 7, 2023

(54) PORTABLE APPARATUS FOR DISPENSING BAGS AND STORING PET WASTE FOR DISPOSAL

(71) Applicant: Linda Broussard, Rocklin, CA (US)

(72) Inventor: Linda Broussard, Rocklin, CA (US)

( * ) Notice: Subject to any disclaimer, the term of this patent is extended or adjusted under 35 U.S.C. 154(b) by 710 days.

(21) Appl. No.: 16/578,384

(22) Filed: Sep. 22, 2019

Related U.S. Application Data

(60) Provisional application No. 62/740,553, filed on Oct. 3, 2018.

(51) Int. Cl.
*E01H 1/12* (2006.01)

(52) U.S. Cl.
CPC ..... *E01H 1/1206* (2013.01); *E01H 2001/126* (2013.01); *E01H 2001/1286* (2013.01)

(58) Field of Classification Search
CPC ..... E01H 1/1206; E01H 2001/126; E01H 2001/1286
See application file for complete search history.

(56) References Cited

U.S. PATENT DOCUMENTS 4,978,095 A * 12/1990 Phillips ..... A47K 10/3818 248/318
6,240,881 B1 * 6/2001 Edwards ..... A01K 27/006 119/795
8,720,384 B2 * 5/2014 Gee ..... A45F 5/00 294/1.3
9,220,379 B2 * 12/2015 Winestock ..... A47K 10/38
9,491,932 B1 * 11/2016 Becattini, Jr. ..... B65D 25/22
2008/0223868 A1 * 9/2008 Sawin ..... B65D 25/205 221/63
2012/0286003 A1 * 11/2012 Shadday ..... E01H 1/1206 206/229

FOREIGN PATENT DOCUMENTS

GB 2458458 A * 9/2009 ..... B65F 1/062
GB 2540978 A * 2/2017 ..... A01K 23/005

OTHER PUBLICATIONS

Baxterboo, "Flexi Multi Box for Flexi Rectractable Dog Leash—Black, IB# 101496", downloaded on Aug. 9, 2021 from https://www.baxterboo.com/p.cfm/flexi-multi-box-for-flexi-retractable-dog-leash-black/, 5 pages.
Kickstarter, "PoopPot—A dog owners best friend", Feb. 12, 2017, downloaded on Aug. 2, 2021 from https://www.kickstarter.com/projects/1131520809/pooppot-a-dog-owners-best-friend?ref=discovery&term=dog%20poop, 7 pages.
Happy Dog Home Boarding, "Dog Blog, PoopPot—Product Review", Apr. 21, 2017, downloaded on Aug. 9, 2021 from https://www.happyhomedogboarding.com/blog/pooppot-product-review, 20 pages.

* cited by examiner

*Primary Examiner* — Stephen A Vu
(74) *Attorney, Agent, or Firm* — O'Banion & Ritchey LLP; John P. O'Banion

(57) ABSTRACT

A portable pet waste collection device which overcomes issues involved with collecting and carrying pet waste when a refuse container is not close by. A lid portion connects to an expandable body portion. A bag dispenser is retained in the lid area through which a user obtains a bag prior to collection. The body portion of the device can be kept in a collapsed state prior to collection, and expanded for receiving a bag of waste. The device conveniently retains the waste bags until proper disposal facilities are available.

10 Claims, 5 Drawing Sheets

PORTABLE APPARATUS FOR DISPENSING BAGS AND STORING PET WASTE FOR DISPOSAL

CROSS-REFERENCE TO RELATED APPLICATIONS

This application claims priority to, and the benefit of, U.S. provisional patent application Ser. No. 62/740,553 filed on Oct. 3, 2018, incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to pet waste management, and more particularly to dispensing bags and storing pet waste for disposal.

2. Background Discussion

Hand carrying bags containing pet waste (e.g., dog poop) is both unsanitary and unseemly (e.g., awkward and smelly), while doing so generally renders various normal hand actions infeasible, such as for example, blowing your nose, adjusting your glasses, answering your phone, holding your child's hand, eating a quick snack, and taking a drink of water or coffee. None of those actions seem appropriate or desirable while holding a bag filled with dog excrement. Further, there might be times when walking a trail or beach where garbage receptacles are not readily available and it is undesirable to leave the mess on the ground or hold a bag of excrement for an extended walk of a mile or two.

Accordingly, a need exists for a simple system which frees ones hands and makes the whole process less objectionable. The present disclosure fulfills that need and provides additional benefits over previous technologies.

BRIEF SUMMARY

A small, portable and convenient apparatus is described that solves many issues associated with carrying filled pet waste bags when a suitable garbage (refuse) container is not readily available.

In one embodiment the apparatus may include a container and cap with a flip up lid. A roll of pet waste bags is integrated on the underside of the flip up lid, and the body of the container can be expanded when more room is needed and collapsed flat to keep it out of the way when it is not being used. In one embodiment the entire apparatus when collapsed is not much taller than a roll of these collection bags. In at least one embodiment an attachment structure is incorporated, such as a small ring tab, for attaching the apparatus to a leash, purse, backpack, stroller, or any place one would prefer to hang the apparatus. In at least one embodiment the attachment is facilitated using a carabiner or similar coupling link. The flip up lid is easy to open and allows filled bags to be deposited into the container through a wide mouth opening. The cap preferably is tall enough to allow the cradle member to hold the bags without interfering and while reserving the majority of interior space for the used pet waste bags.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

FIG. 1 through FIG. 6 illustrate a non-limiting embodiment of a portable apparatus for dispensing bags and storing pet waste for disposal according to the present disclosure. In use a bag is dispensed through the lid. Prior to collecting the waste material, the body of the waste collection device is expanded. After waste collection the top of the pet waste bag is closed (tied or other closure means). Then the lid of the device is opened and the bag containing pet waste is deposited into the device after which the lid is closed.

Figure 1:
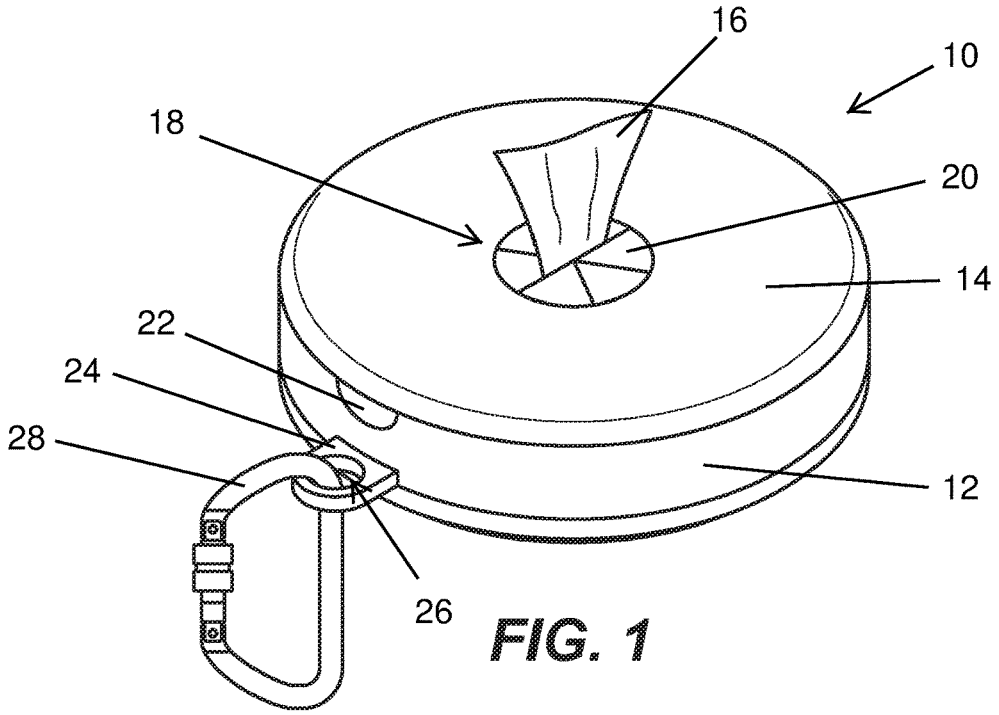
FIG. 1 is a perspective view of an embodiment of a portable apparatus for dispensing bags and storing pet waste for disposal shown in a collapsed configuration.
Figure 2:
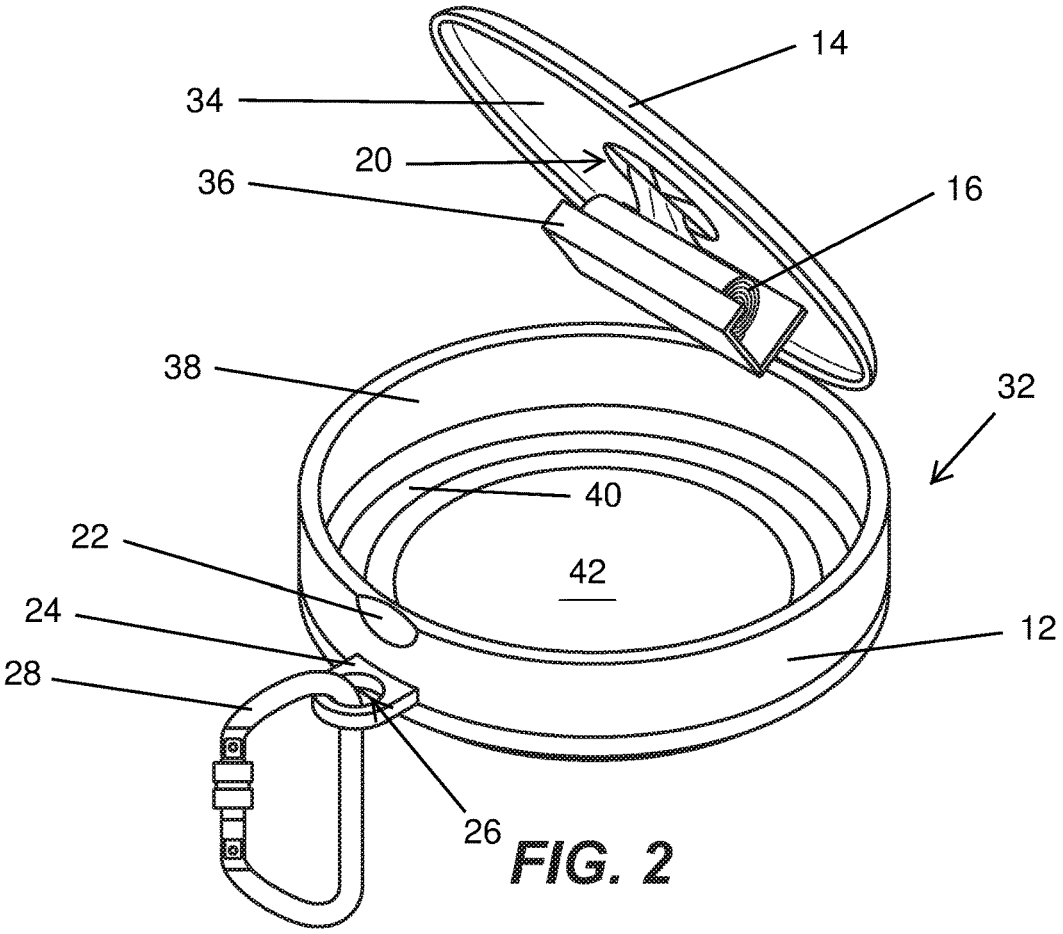
FIG. 2 is a perspective view of the apparatus of FIG. 1 shown with the flip-up lid in an open position.

Referring first to FIG. 1 and FIG. 2, the apparatus 10 is shown in a collapsed or flattened position. In the embodiment shown, the apparatus includes a container 12 with a flip-up type lid 14. The apparatus can store a roll of pet waste, "dog poop", bags 16 that can be dispensed through an opening 18, for example formed by a plurality of compliant (flexible) flaps 20 in the lid 14. In the depicted example the flaps are triangular-shaped. In at least one preferred embodiment the apparatus utilizes bags available in a roll form in which perforations are provided between bags to simplify separation. The sharp points and radial configuration of the flaps 20 facilitate separating (singulating) individual bags 16 at their perforations.

At least one depression, notch, cutout, combination thereof or other means 22 can be provided in the container near the edge of the lid opposite to the hinge to assist the user with opening the lid with the user's finger or the like. Alternatively or additionally, the lid itself can incorporate a tab (protrusion) or the like (not shown) for such purpose of opening the lid.

Figure 4:
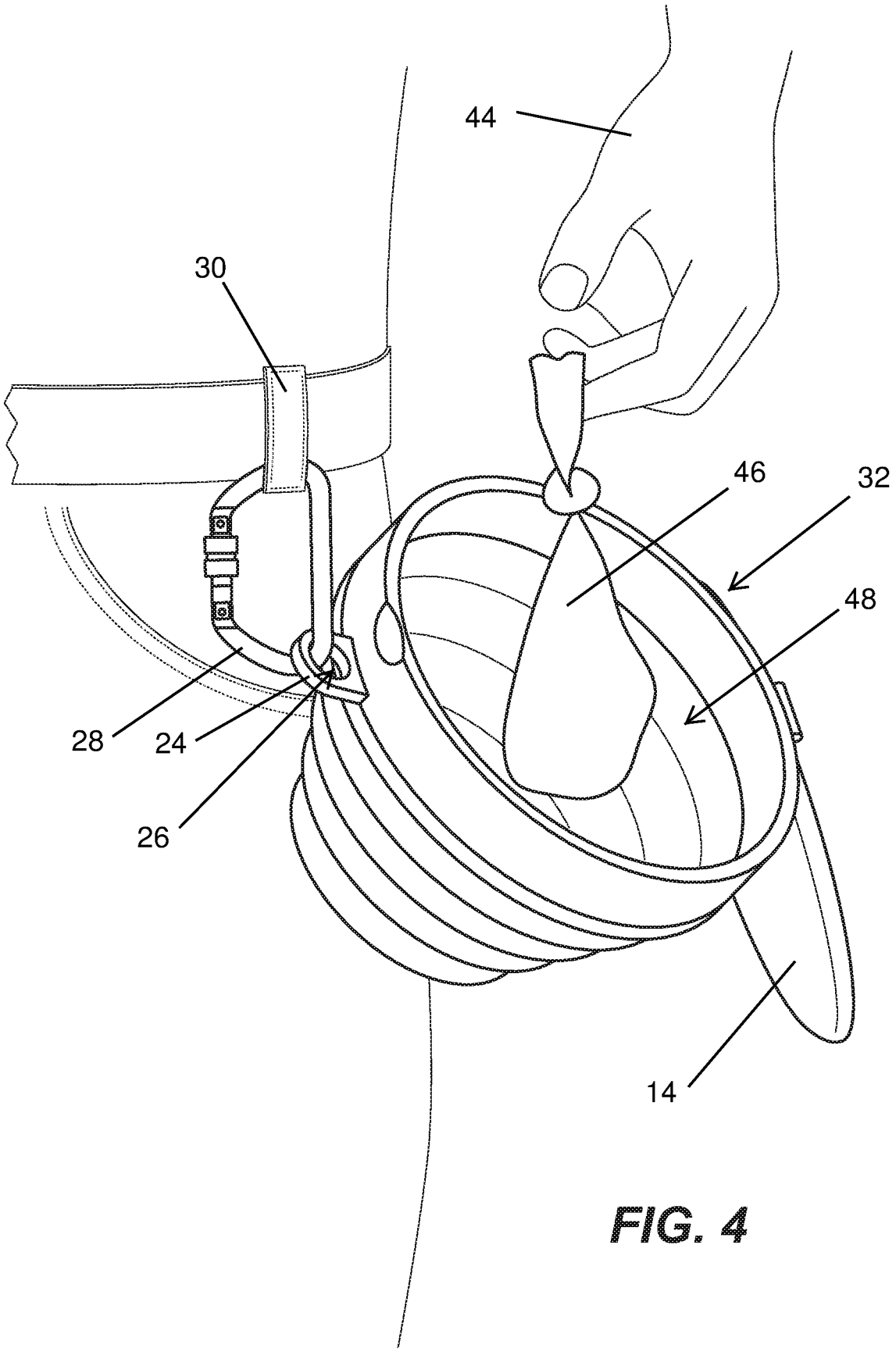
FIG. 4 is a perspective view of the apparatus of FIG. 3 showing the apparatus attached to a belt loop, the flip-up lid shown fully open, and showing a user depositing a filled bag into the container.

A small ring tab 24 or other means may be provided on the container below the depression for attaching the apparatus to an object for carrying the apparatus. The ring tab preferably is placed sufficiently below the depression to avoid interference. The ring tab includes a hole 26 to which a carabiner 28 or other fastener can be attached for carrying the apparatus on a belt loop 30 or other article as shown in FIG. 4. The ring tab could be placed in other locations but placement below the depression is preferred so that when the lid is opened the carabiner 28 would hold the apparatus in a position that allows the lid to stay open from gravity, allowing more convenient access to the mouth 32 of the container as is illustrated in FIG. 4 in which a user 44 is depositing a filled pet waste bag 46 through mouth 48 of the apparatus.

Figure 3:
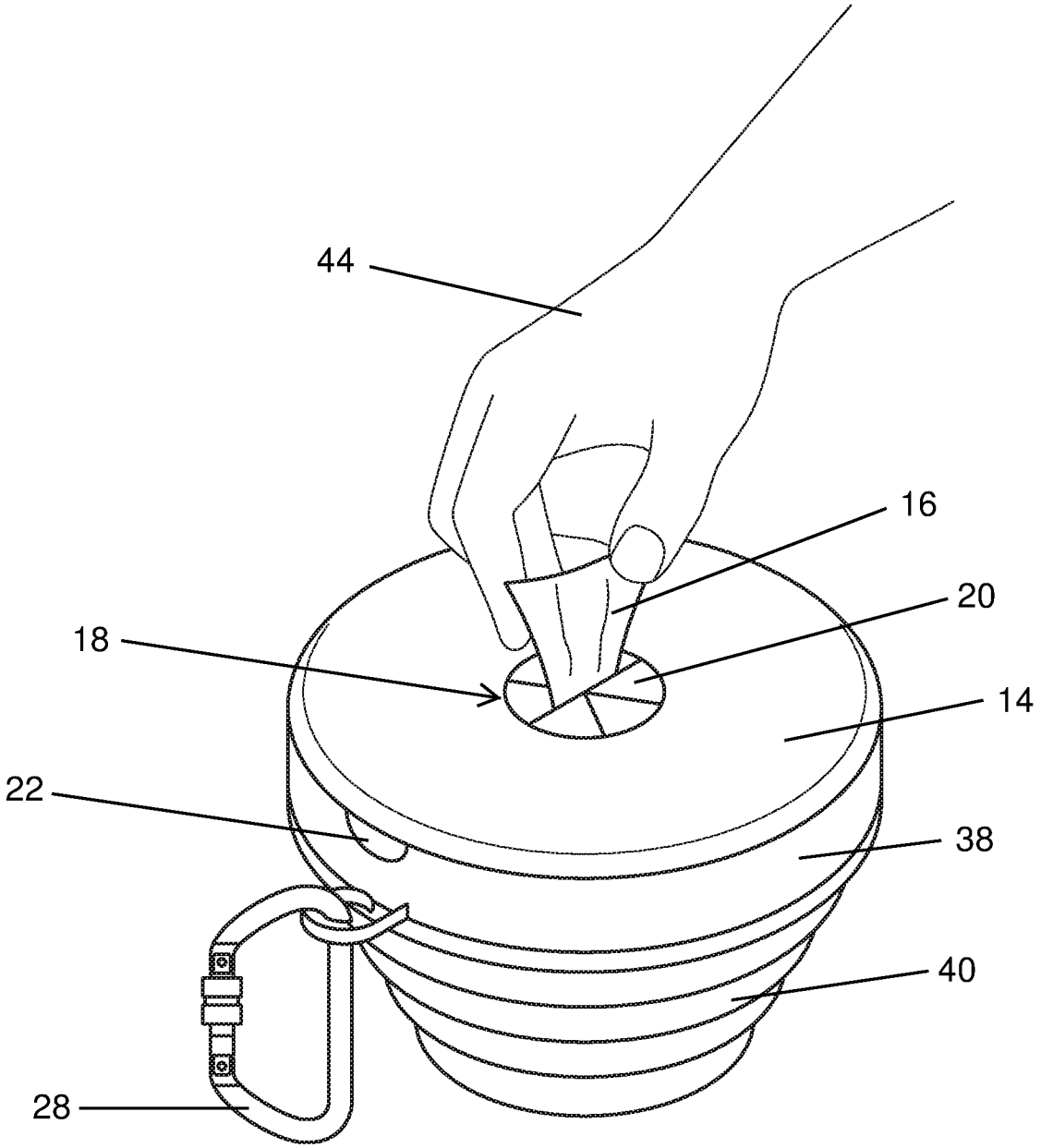
FIG. 3 is a perspective view of the apparatus of FIG. 2 shown with the container body in an expanded position.
Figure 5:
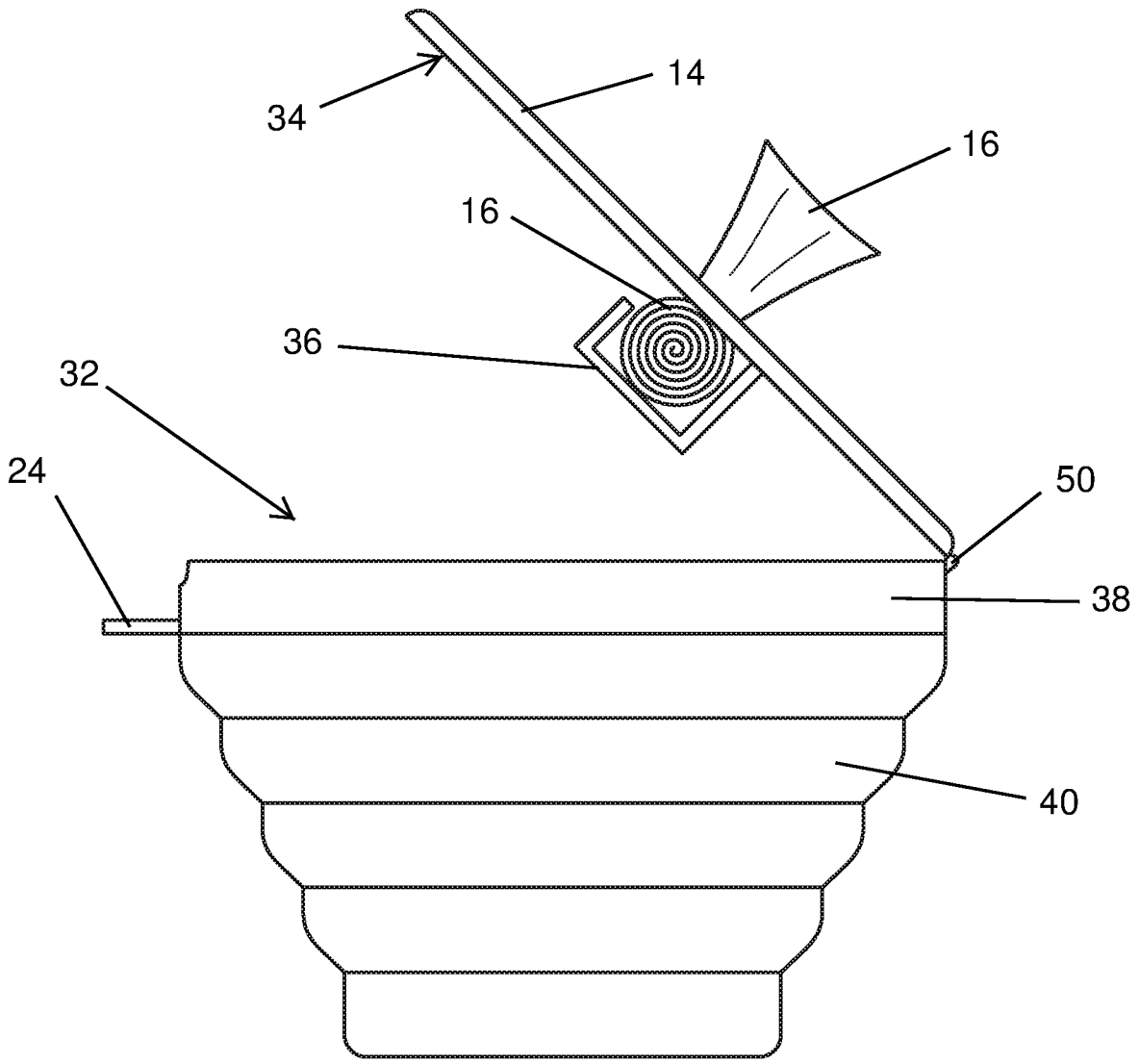
FIG. 5 is a side view of the apparatus shown in FIG. 3 with the flip-up lid shown partially open.

FIG. 2 and FIG. 5 show that the underside 34 of the lid includes a U-shaped cradle member 36 that is configured for holding a roll 16 of bags. FIG. 2 and FIG. 3 show that the container may include a stationary wall portion 38, an accordion-style collapsible/expandable wall portion 40, and a bottom portion 42. By pushing (or pulling) on the bottom portion of the container the user 44 can expand the container as shown in FIG. 3. It should be noted that in at least one embodiment the device can be expanded from a collapsed state through at least one intermediate state of expansion to a state of full expansion, thus allowing the device to be kept as small as practical for the amount of waste it retains. The user reversibly can collapse the container to its original flattened configuration. To facilitate such expansion and collapsing of the container, in at least one embodiment the container is preferably formed from a flexible material such as from a synthetic or natural polymeric material (i.e., elastomeric materials, latex, silicon, certain thermoplastics, rubber, and so forth) that is sufficiently resilient to withstand collapsing and expanding the container through numerous duty cycles without breaking. FIG. 4 shows the lid flipped open and the user's hand 44 depositing a filled pet waste bag 46 into the receptacle 48 in the expanded container.

FIG. 5 shows that the lid is attached to the container using a hinge 50. Preferably the hinge is integrally molded as part of the lid and container assembly so as to form an integral connection. Other hinges known to those skilled in the art can be used as well. The hinge should be flexibly and sufficiently resilient to withstand repeated opening and closing of the lid without breaking.

Figure 6:
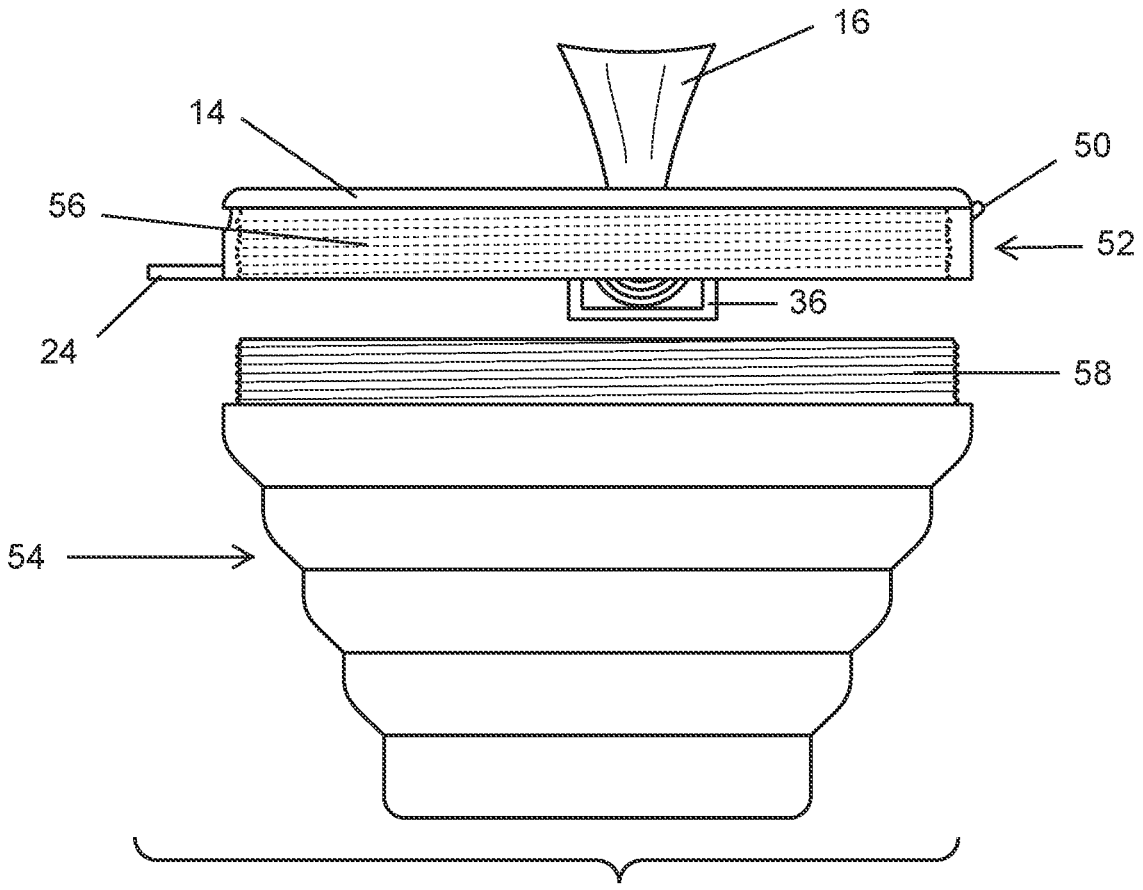
FIG. 6 is an exploded side view of the apparatus of FIG. 3 showing a multiple section embodiment having engagement threads on a cap and on the container.

FIG. 6 shows an alternative embodiment of the apparatus comprising multiple sections which are engaged to form the apparatus. In the example shown these sections comprise a cap 52 and container body 54. In this embodiment, the lid and ring tab are part of the cap. As shown, the cap has corresponding interior threads 56 and the container body has exteriors threads 58. Alternatively, the cap and body may be configured for a snap tab connection (e.g., one or more protruding structures on cap or body that engage one or more recesses in the body or cap). According to these embodiments the cap can be removed and reattached to the container body. This configuration facilitates emptying the apparatus. It should be appreciated that other fastening means may be utilized without departing from the teachings of the present disclosure.

In the embodiments illustrated the apparatus has a preferred tapering cylindrical shape. It will be appreciated, however, that the apparatus can be configured in other shapes and sizes without departing from the teachings of the present disclosure.

Accordingly it can be seen that the apparatus solves problems associated with carrying filled pet waste bags when a suitable garbage container is not available. Carrying pet waste bags by hand is unsanitary and smelly, and also makes various normal hand actions infeasible and undesirable while holding a bag filled with pet waste. Further, there can be times while walking on a trail or beach where garbage receptacles are not available and it is undesirable hold a pet waste bag for a mile or two. The apparatus described in this disclosure solves those problems in a small, portable form factor. The ability of the apparatus to be collapsed flat and the fact that it replaces a pet owner's current pet waste bag holder make it a discreet, convenient, all-in-one solution for a dog walker or other pet owner. The flip up lid is easy to open and allows used pet waste bags to be deposited into the container through a wide mouth opening. The cap preferably is tall enough to allow the cradle member to hold the bags without interfering so that the majority of interior space is reserved for the used pet waste bags.

In at least one embodiment the interior of the apparatus can be configured with a structure for retaining an air freshener, such as in a stick-on, packet or bead form. For example on the underside of the flip top lid is a flat space near the cradle member which is configured for receiving a small disposable stick on deodorizer or air freshener, so that fresh smelling air is available when the flip top lid is opened.

The apparatus, created in a larger size, without the waste bag dispenser, could also be utilized by anyone needing a place to hold small items to be thrown away when a garbage container is located. Examples where this would be handy are such as on a hike with a backpack, in the car on a road trip, on a fishing boat, on a walk with a baby stroller, or similar scenarios.

From the description herein, it will be appreciated that the present disclosure encompasses multiple embodiments which include, but are not limited to, the following:

1. An apparatus for dispensing bags and storing pet waste for disposal, the apparatus comprising: (a) an expandable container; (b) a flip-up type lid connected to the expandable container by at least one hinge; (c) an opening in the lid formed by a plurality of flexible flaps; (d) a cradle member beneath the lid, said cradle member configured to support a perforated roll of bags; (e) wherein said opening in the lid is configured for singulating bags, from the perforated roll of bags, which are to be threaded through the lid and then separated by said flaps for dispensing; (f) said container is reconfigurable between at least a collapsed position and an expanded position; (g) wherein said expanded position of said container is configured to hold one or more of said bags filled with a material for later disposal; and (h) a retention structure configured for attaching said apparatus to an object when carrying said apparatus.

2. An apparatus for dispensing bags and storing pet waste for disposal, the apparatus comprising: (a) an expandable container; (b) a flip-up type lid connected to the expandable container by a hinge; (c) at least one depression, notch, cutout, protrusion or combination thereof opposite said hinge toward facilitating opening said lid; (d) an opening in the lid formed by a plurality of flexible flaps; (g) a cradle member beneath the lid configured to support a perforated roll of bags; (h) wherein said opening in the lid is configured for singulating bags, from the perforated roll of bags, which are to be threaded through the lid and then separated by said flaps for dispensing; (i) said container is reconfigurable between a collapsed position and an expanded position and is fabricated from a flexible material of sufficient resiliency to withstand collapsing and expanding the container through numerous duty cycles; (j) wherein in said expanded position said container is configured to hold one or more of said bags filled with a material for later disposal; and (k) a retention structure configured for attaching said apparatus to an object when carrying said apparatus.

3. An apparatus for dispensing bags and storing pet waste for disposal, the apparatus comprising: a container; a flip-up type lid connected to the container by a hinge; an opening in the lid formed by a plurality of triangular-shaped flaps; a cradle member beneath the lid configured to support a perforated roll of bags; wherein said bags can be threaded through the opening in the lid and separated (singulated) by said flaps for dispensing; said container reconfigurable between a collapsed position and an expanded position; wherein in said expanded position said container is configured to hold one or more of said bags filled with a material for later disposal; means for assisting a user with opening said lid; and means for attaching said apparatus to an object for carrying said apparatus.

4. The apparatus of any preceding embodiment, wherein said expandable container comprises a flexible material of sufficient resiliency to withstand collapsing and expanding the container through numerous duty cycles.

5. The apparatus of any preceding embodiment, wherein said flexible material comprises a synthetic or natural polymeric material.

6. The apparatus of any preceding embodiment, wherein said polymeric material is selected from the group of polymeric materials consisting of elastomeric materials, latex, silicon, certain thermoplastics, rubber, and so forth.

7. The apparatus of any preceding embodiment, wherein said retention structure comprises a ring tab configured for engaging a removable fastener.

8. The apparatus of any preceding embodiment, further comprising at least one depression, notch, cutout, protrusion or combination thereof opposite said hinge toward facilitating opening said lid.

9. The apparatus of any preceding embodiment, wherein said expandable container comprises multiple sections that are engaged to form the apparatus.

10. The apparatus of any preceding embodiment, wherein said multiple sections comprise a cap section to which said lid is attached, and a body section which is expandable.

11. The apparatus of any preceding embodiment, wherein said cap section and said body section are fastened together by threadable engagement or snap tabs.

12. The apparatus of any preceding embodiment, wherein said flexible material comprises a synthetic or natural polymeric material.

13. The apparatus of any preceding embodiment, wherein said polymeric material is selected from the group of polymeric materials consisting of elastomeric materials, latex, silicon, certain thermoplastics, rubber, and so forth.

14. The apparatus of any preceding embodiment, wherein said retention structure comprises a ring tab configured for engaging a removable fastener.

15. The apparatus of any preceding embodiment, wherein said expandable container comprises multiple sections that are engaged to form the apparatus.

16. The apparatus of any preceding embodiment, wherein said multiple sections comprise a cap section to which said lid is attached, and a body section which is expandable.

17. The apparatus of any preceding embodiment, wherein said cap section and said body section are fastened together by threadable engagement or snap tabs.

As used herein, the singular terms "a," "an," and "the" may include plural referents unless the context clearly dictates otherwise. Reference to an object in the singular is not intended to mean "one and only one" unless explicitly so stated, but rather "one or more."

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

Phrasing constructs, such as "A, B and/or C", within the present disclosure describe where either A, B, or C can be present, or any combination of items A, B and C. Phrasing constructs indicating, such as "at least one of" followed by listing group of elements, indicates that at least one of these group elements is present, which includes any possible combination of these listed elements as applicable.

References in this specification referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. An apparatus for dispensing bags and storing pet waste for disposal, the apparatus comprising:

an expandable container body having an open end and an interior;

a cap attachable to the container body at the open end of the container body, said cap having an opening to the interior of the container body;

a lid connected to the cap by at least one hinge, said lid providing access to the interior of the container body;

wherein said cap is reversibly attachable to the container body by threadable engagement or snap tabs;

an opening in the lid formed by a plurality of flexible flaps;

a cradle member beneath the lid, said cradle member configured to support a perforated roll of bags;

wherein said opening in the lid is configured for singulating bags, from the perforated roll of bags, which are to be threaded through the lid and then separated by said flaps for dispensing;

wherein said container body is reconfigurable between at least a collapsed position and an expanded position;

wherein said expanded position of said container body is configured to hold one or more of said bags filled with a material for later disposal; and a retention structure configured for attaching said apparatus to an object when carrying said apparatus.

2. The apparatus of claim 1, wherein said expandable container body comprises a flexible material of sufficient resiliency to withstand collapsing and expanding the container through numerous duty cycles.

3. The apparatus of claim 2, wherein said flexible material comprises a synthetic or natural polymeric material.

4. The apparatus of claim 3, wherein said polymeric material is selected from the group of polymeric materials consisting of elastomeric materials, latex, silicon, certain thermoplastics and rubber.

5. The apparatus of claim 1, wherein said retention structure comprises a ring tab configured for engaging a removable fastener.

6. The apparatus of claim 1, further comprising at least one depression, notch, cutout, protrusion or combination thereof opposite said hinge toward facilitating opening said lid.

7. An apparatus for dispensing bags and storing pet waste for disposal, the apparatus comprising:

an expandable container body having an open end and an interior;

a cap attachable to the container body at the open end of the container body, said cap having an opening to the interior of the container body;

wherein said cap is reversibly attachable to the container body by threadable engagement or snap tabs;

a lid connected to the cap by a hinge, said lid providing access to the interior of the container body;

at least one depression, notch, cutout, protrusion or combination thereof opposite said hinge toward facilitating opening said lid;

an opening in the lid formed by a plurality of flexible flaps;

a cradle member beneath the lid configured to support a perforated roll of bags;

wherein said opening in the lid is configured for singulating bags, from the perforated roll of bags, which are to be threaded through the lid and then separated by said flaps for dispensing;

wherein said container body is reconfigurable between a collapsed position and an expanded position and is fabricated from a flexible material of sufficient resiliency to withstand collapsing and expanding the container body through numerous duty cycles;

wherein in said expanded position said container body is configured to hold one or more of said bags filled with a material for later disposal; and a retention structure configured for attaching said apparatus to an object when carrying said apparatus.

8. The apparatus of claim 7, wherein said flexible material comprises a synthetic or natural polymeric material.

9. The apparatus of claim 8, wherein said polymeric material is selected from the group of polymeric materials consisting of elastomeric materials, latex, silicon, certain thermoplastics and rubber.

10. The apparatus of claim 7, wherein said retention structure comprises a ring tab configured for engaging a removable fastener.

* * * * *